United States Patent [19]

Nervina

[11] Patent Number: 4,840,041

[45] Date of Patent: Jun. 20, 1989

[54] AIR CONDITIONER WALL SLEEVE

[76] Inventor: Eugene E. Nervina, 100 Manhattan Ave. (910), Union City, N.J. 07087

[21] Appl. No.: 186,233

[22] Filed: Apr. 26, 1988

[51] Int. Cl.[4] ..... F25D 23/12

[52] U.S. Cl. ..... 62/263

[58] Field of Search ..... 62/262, 263; 98/114; 312/101

[56] References Cited

U.S. PATENT DOCUMENTS

| | | | |
|---|---|---|---|
| 3,756,039 | 9/1973 | Riello | 62/262 |
| 3,789,619 | 2/1974 | Kincaid et al. | 62/262 |
| 4,304,175 | 12/1981 | Lang | 98/114 |
| 4,307,579 | 12/1981 | Bolton | 62/262 |
| 4,325,229 | 4/1982 | Dezurik | 98/114 |
| 4,555,983 | 12/1985 | Bolton et al. | 62/263 X |
| 4,573,328 | 3/1986 | Bolton et al. | 62/263 |
| 4,729,227 | 3/1988 | Peden | 62/263 |

*Primary Examiner*—Lloyd L. King
*Attorney, Agent, or Firm*—Leon Gilden

[57] ABSTRACT

An air conditioner wall sleeve is et forth for use in combination with window-type air conditioning units for through-the-wall construction. The wall sleeve is of a height and depth substantially that of an associated air conditioning unit, but is of a width greater than said unit. Spacer blocks of varying dimensions are securable at a forwardmost point of respective side walls of the wall sleeve to present planar surfaces with a distance therebetween within said sleeve to substantially equal that of an air conditioning unit's width. Louvers are formed along a rear surface of said wall sleeve whereupon a gap is presented between side interior walls rearwardly of said adapters for enabling venting of heated discharge air rearwardly of said air conditioning unit and for enabling intake of fresh air to said unit.

6 Claims, 3 Drawing Sheets

AIR CONDITIONER WALL SLEEVE

BACKGROUND OF THE INVENTION

1. Field of the Invention

The present invention relates to air conditioners and their securement to existing structures and more particularly pertains to a new and improved air conditioning wall sleeve to enable a single rearward louvered face of a wall sleeve positionable and securable to an exterior surface of a dwelling to enable exhaust and intake air to be provided to an associated air conditioning unit.

2. Description of the Prior Art

The use of wall air conditioning units of compact size is well known in the prior art. Traditionally these units have been positioned to existing windows and have been termed window units. The window units are manufactured of varying capacities measured in BTU designations within approximately 6,000 BTU and 36,000 BTU ratings. Units of this type are traditionally formed of an exhaust rear surface extending outwardly to exhaust hot air produced through the air conditioning cycle. Intake air is conventionally oriented on side walls of the air conditioning unit adjacent the rear exhaust grills.

The air conditioning window units of this category have proven to be somewhat unsightly and various cabinets and constructions have been implemented to provide a housing for the air conditioning units to improve their appearance as they project outwardly of a dwelling wall or window. Furthermore, when such a window unit is installed through a window, a portion of light entering an associated room to the window is eliminated and therefore the practice of positioning such window units through existing wall to avoid their positioning within a window has been common practice in the industry. Unfortunately when a through-the-wall orientation is effected with such window units, the side intake grills are generally blocked to a certain extent and accordingly a more expensive through-the-wall window unit has been developed with the air intakes on the same rear surface as the hot air exhaust. The efficiency of such a unit is greatly reduced due to the heated discharge air entering and leaving the same rear face of the unit whereby total surface area is considerably reduced for both the intake and exhaust of the air conditioning unit and accordingly such units are of diminished capacity.

Examples of existing air conditioning units may be found in U.S. Pat. No. 3,756,039 to Riello wherein a traditional air conditioning unit is set forth with associated passages for cold and warm air streams effected as a result of the air conditioning cycles. The patent is of a relatively complex structure and the utilization of such a cabinet organization would effect increased cost and complexity in the positioning of window units in a through-the-wall installation in existing dwellings.

U.S. Pat. No. 4,170,880 to Lou sets forth a window-type air conditioner formed with a shield installed on the air conditioner of a case at the rear compartment to either block ventilation passageways provided the rear portion when the air conditioner is not use or to admit air to the air conditioning unit when the air conditioner is in use. The shield is slidably pivotally movable relative to an air conditioning passageway to effect such orientations. The shield of the Lou patent is of interest relative to the selective adjustment of air conditioning venting, but is of a relatively remote organization and function as to the instant invention.

U.S. Pat. No. 4,304,175 to Lang sets forth a grill assembly for use with an air conditioning unit wherein a grill is attached to an associated casing with means for providing securement of the grill to the casing from the interior of the casing to enhance the decorative effect of the associated casing for the air conditioning unit. The patent is of interest relative to the illustrations of a relatively decorative and protective casing for an air conditioning unit, but fails to solve the problems associated with contemporary through-the-wall units utilized in a through-the-wall construction and mounting of a conventional air conditioner.

U.S. Pat. No. 4,307,579 to Bolton sets forth an apparatus wherein an air discharge assembly for use with a room air conditioner is pivotally mounted at its ends with a tab extending therefrom into a slot formed into a frame of a front panel of an associated air conditioning unit. The tab and slot interact to limit inward deflection of the discharge door and raised generally to a means for stiffening a discharger door for use with conventional air conditioning units. The patent and its solution is of interest relative to the field of endeavor associated with contemporary window mounted air conditioning units, but does not present a soluiton to the problem as set forth by the instant invention requiring a maintaining of adequate discharge intake area to conventional window-type units for use in a through-the-wall installation.

The instant invention overcomes the deficiencies of the prior art by enabling utilization of window units in through-the-wall installation where the through-the-wall window units are of improved energy efficiency and of reduced cost as opposed to through-the-wall units.

As such, it may be appreciated that there is a continuing need for a new and improved air conditioner wall sleeve to enable use of traditional window units in a through-the-wall installation which addresses both the problem of maintaining efficiency and aesthetic appeal as well as protection of an associated window unit and in this respect, the present invention substantially fulfills this need.

SUMMARY OF THE INVENTION

In view of the foregoing disadvantages inherent in the known types of air conditioning units now present in the prior art, the present invention provides an air conditioning wall sleeve which enables the use of traditional and more efficient window units utilized in a through-the-wall installation of existing dwellings. As such, the general purpose of the present invention, which will be described subsequently in greater detail, is to provide a new and improved air conditioning wall sleeve to utilize window units which has all the advantages of the prior art through-the-wall air conditioner units and none of the disadvantages.

To attain this, the present invention comprises an air conditioner wall sleeve of generally parallel pipet cross-sectional configuration formed with an array of louvers parallel and coextensively arranged along a rear surface of said sleeve and formed with a plurality of positionable adapters securable to interior side walls of said sleeve presenting surfaces parallel with respect to one another and generally orthogonally arranged to said louver and a forward face of said sleeve whereby they are of a distance to substantially equal that of an intended air conditioning unit's width and of a length along respective interior side surfaces of said sleeve approximately half the distance of the interior side surfaces measured along the side wall's length to provide spacings between said sleeve and said louvers to enable conventional air conditioning intake surfaces to accept air through said space and through said louvers.

My invention resides not in any one of these features per se, but rather in the particular combination of all of them herein disclosed and claimed and it is distinguished from the prior art in this particular combination of all of its structures for the functions specified.

There has thus been outline, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved air conditioner wall sleeve which has all the advantages of the prior art air conditioner wall sleeves and none of the disadvantages.

It is another object of the present invention to provide a new and improved air conditioner wall sleeve which may be easily and efficiently manufactured and marketed.

It is a further object of the present invention to provide a new and improved air conditioner wall sleeve which is of a durable and reliable construction.

An even further object of the present invention is to provide a new and improved air conditioner wall sleeve which is susceptible of a low cost of manufacture with regard to both materials and labor, and which accordingly is then susceptible of low prices of sale to the consuming public, thereby making such air conditioner wall sleeves economically available to the buying public.

Still yet another object of the present invention is to provide a new and improved air conditioner wall sleeve which provides in the apparatuses and methods of the prior art some of the advantages thereof, while simultaneously overcoming some of the disadvantaqges normally associated therewith.

Still another object of the present invention is to provide a new and improved air conditioner wall sleeve to enable utilization of conventional window unit air conditioners and through-the-wall construction of dwellings by providing a rear louvered surface and spacings therebetween interior side walls and a positioned air conditioning unit to enable flow of intake air through side portions of said louvers and into the associated air conditioning intake units.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
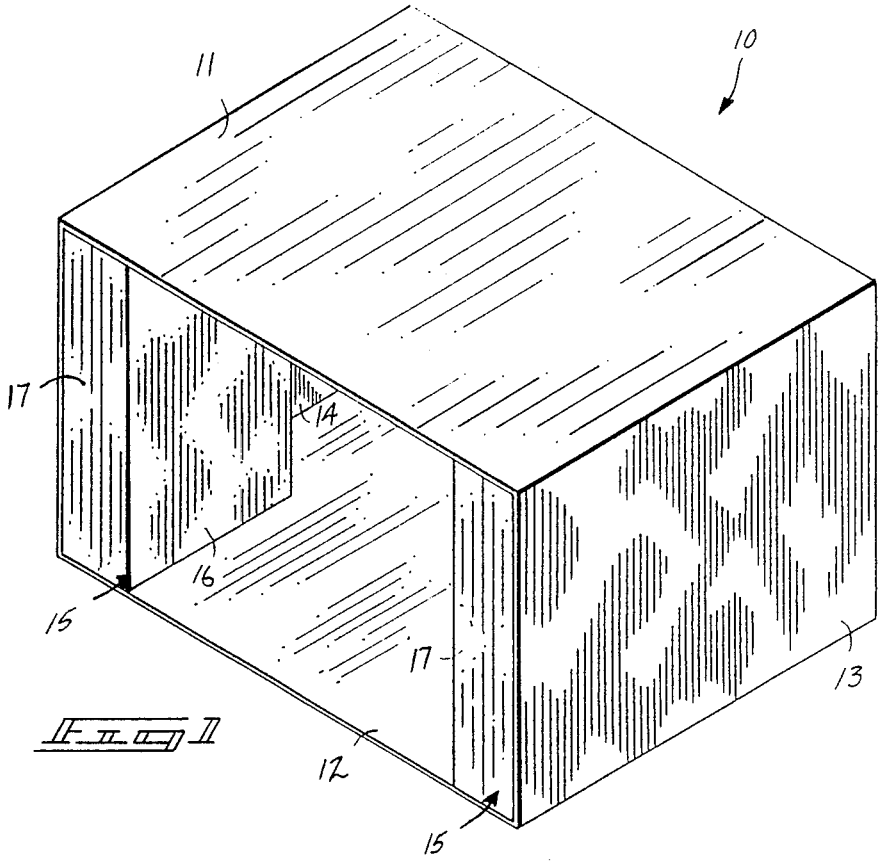
FIG. 1 is an isometric illustration of the instant invention with associated adapters positioned to interior forward side wall portions.

With reference now to the drawings, and in particular to FIGS. 1 to 7 thereof, a new and improved air conditioning sleeve embodying the principles and concepts of the present invention and generally designated by the reference numeral 10 will be described.

More specifically, it will be noted that the air conditioning wall sleeve apparatus 10 essentially comprises a cabinet structure formed with a top wall 11, a bottom wall 12, a first side wall 13 orthogonally formed to said top wall and bottom wall, and a second side wall 14 parallel to said first side wall 13.

Figure 2:
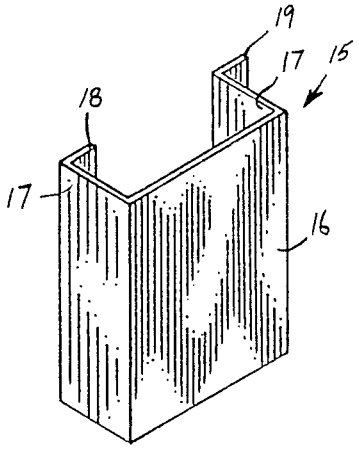
FIG. 2 is an isometric illustration of an adapter as utilized with the instant invention.
Figure 3:
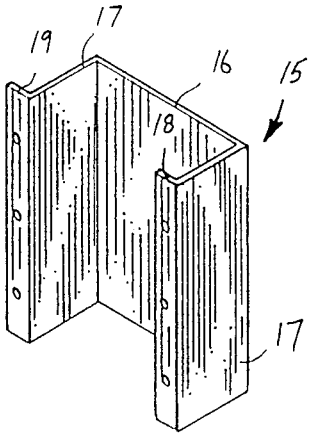
FIG. 3 is an isometric illustration of the adapter of FIG. 2 rotated forty-five degrees about a central axis.

An adapter 15 of a generally U shape, as illustrated in FIGS. 2 and 3, is secured at forwardmost portions of said first and second side walls, as illustrated in FIG. 1, wherein said adapter 15 is formed with opposed and parallel face surface 16 with orthogonally depending spacing walls 17 secured integrally thereto with a first inward flange 18 and a second outward flange 19.

Figure 6:
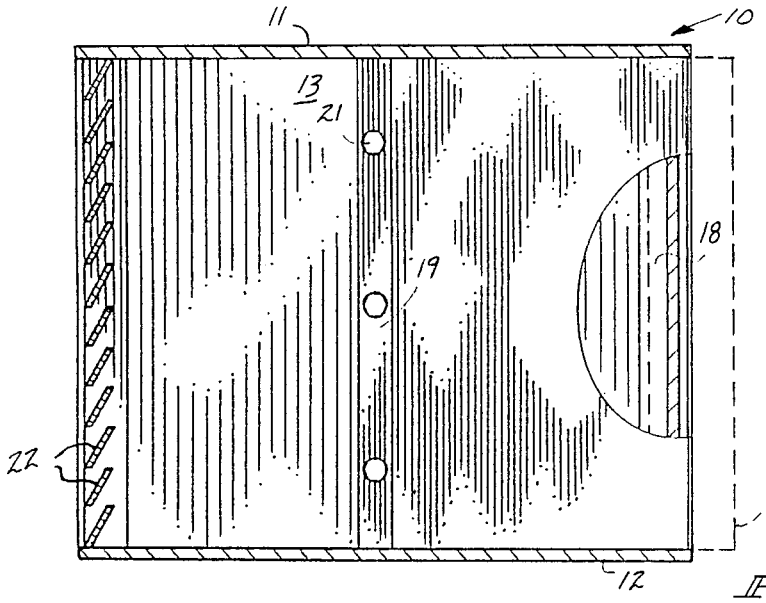
FIG. 6 is an orthographic view of the instant invention taken along the lines 6—6 of FIG. 5 in the direction indicated by the arrows.
Figure 7:
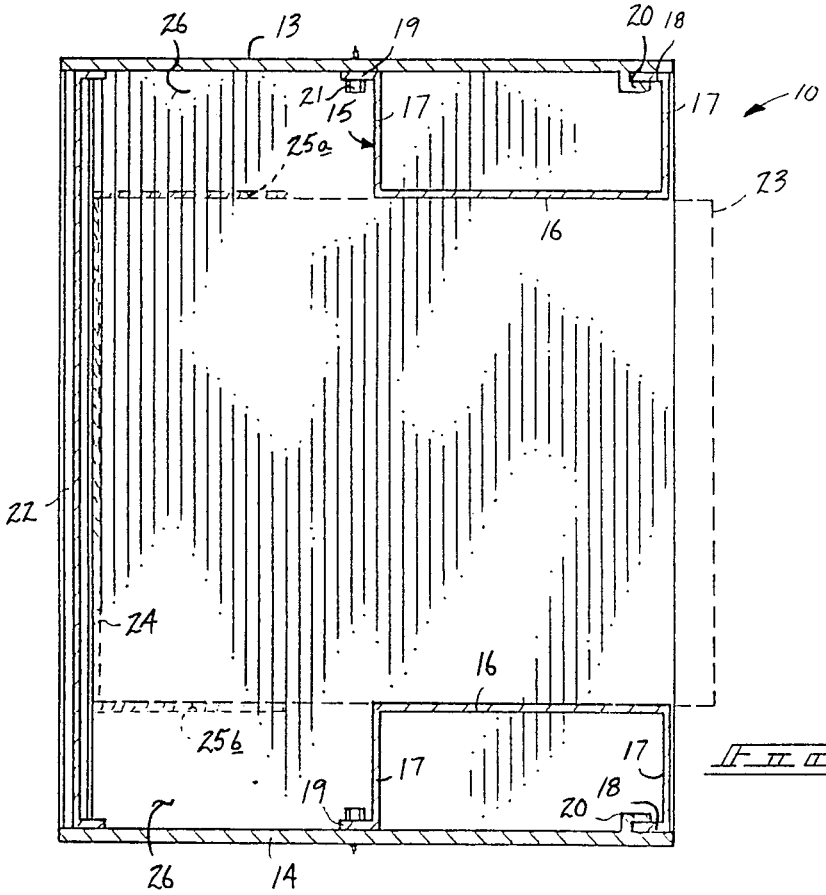
FIG. 7 is an orthographic view of the instant invention taken along the lines 7—7 of FIG. 5 in the direction indicated by the arrows.

With reference to FIG. 7 for example, inward flange 18 is securable within an associated "L" shaped side wall flange 20 secured proximate forward ends of the side walls 13 and 14 to define a space of a complementary thickness to the respective flanges 18. Openings are formed throughout flanges 18 and 19 to accept fasteners 21, as illustrated in FIG. 6 for example, to secure the respective adapters 15 at forwardmost portions of the side walls 13 and 14.

Figure 4:
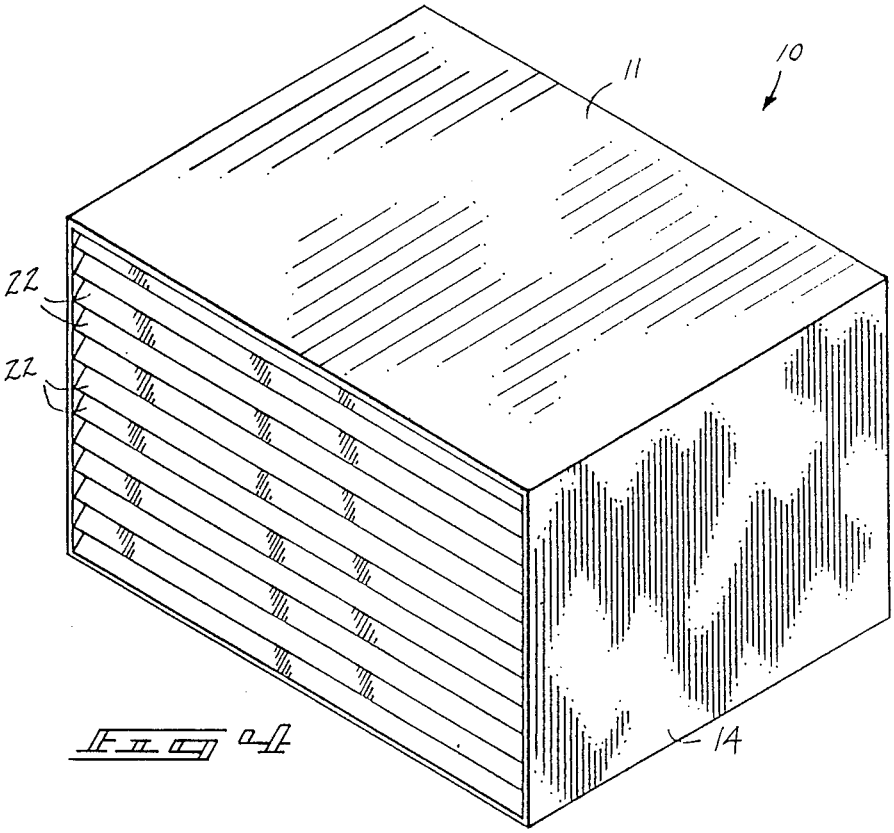
FIG. 4 is an isometric illustration of the instant invention illustrating the rear construction thereof.
Figure 5:
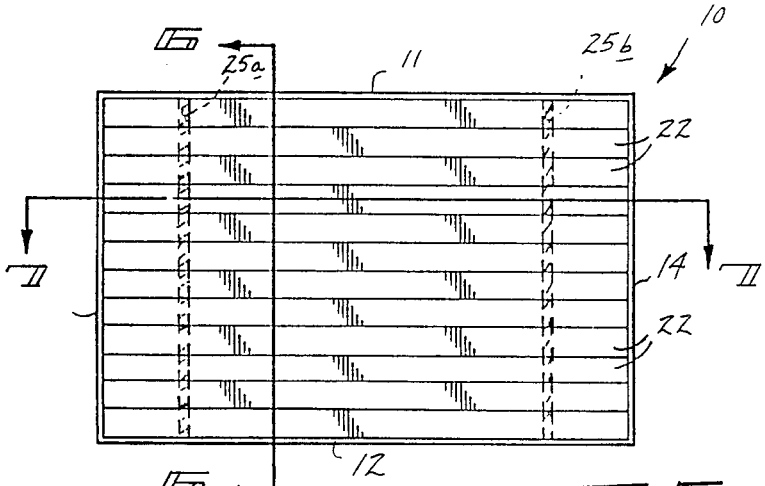
FIG. 5 is a rear orthographic view taken in elevation of the instant invention.

The wall sleeve 10 has secured about its rear face a series of parallel rear facing louvers 22, as illustrated in FIGS. 4 and 5. The downwardly angulated louvers 22 provide integrity to the wall sleeves 10 and deflect rain and dust from entering the interior of the sleeve.

With reference to FIGS. 5, 6 and 7 it is to be noted that an air conditioning window unit 23 of conventional and well known construction is illustrated in phantom and is insertable and of a width equal to the spacing between face surfaces 16 of adapters 15. Accordingly it may be appreciated that the spacing walls 17 may be provided of varying widths to provide a combination of varying sized air conditioning window units 23. Conventional, as with such window units, a series of rear air conditioning louvers 24 are formed to the air conditioning unit, as illustrated in FIG. 7, for conventional directing of discharged hot air resultant from the air conditioning cycle. Also consistent with such air conditioning window unit construction, side louvers 25*a* proximate first side wall 13 and second side louvers 25*b* of the air conditioning window unit are proximate the second side wall 14. Accordingly an intake space 26 is resultant from the spacing of adapter 15 relative to the rear facing louvers 22 and the spacing between the air conditioning louvers 25*a* and 25*b* and respective side walls 13 and 14.

In this fashion, the side louvers 25*a* and 25*b* are of conventional construction to enable intake of air for the operation of the air conditioning window unit 23. Reference to FIG. 5 illustrates the side louvers 25*a* and 25*b*, whereupon the distance between the side louvers 25*a* and side wall 13 and that between side louvers 25*b* and side wall 14 illustrates the manner in which intake air is directed through that spacing, whereupon the discharge of heated air is directed outwardly of the air conditioning unit 23 through its rear louvers 24 that are positioned between side louvers 25*a* and 25*b* and directed outwardly of the sleeve 10 through the louvers 22.

The apparatus 10 is positioned in use through conventional side walls of a dwelling with the rear facing louvers 22 directed outwardly of the dwelling, as is to be understood.

As to the manner of usage and operation of the instant invention, the same should be apparent from the above description. Accordingly, no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An air conditioning wall sleeve for use in combination with a window unit air conditioner including a top face, bottom face, side faces, a forward face, and a rear face therein defining outward surfaces of said air conditioner wherein said rear face includes a rear discharge vent for exhausting heated air from said air conditioner and side vents secured to rear portions of each side face of said air conditioner oriented adjacent said rear discharge vent on said side faces, said sleeve comprising, a cabinet including a top wall, a bottom wall, a first side wall, and a second side wall defining a rectangular parallel piped, and a plurality of generally "U" shaped adapter means secured to an interior surface of each side wall wherein said adapter means is defined by a height substantially equal to a distance between said top wall and bottom wall and of a depth less than that of either side wall wherein said adapter means extends along the interior surface of each side wall a distance substantially less than that of the side wall, and each of said plurality of adapter means spaced a distance apart between each other to substantially equal the distance between the side faces of the air conditioner, and said cabinet including a plurality of rear louvers to define a rear wall of said cabinet of a length greater than the that of the rear face of the air conditioner, and wherein said cabinet defines a space means between said adapter means and said rear wall and between the side vents of the air conditioner and the interior surfaces of each side wall opposed to said side vents for enabling intake air to be directed through said louvers and said space means and ultimately directed to said side vents.

2. An air conditioning wall sleeve as set forth in claim 1 wherein said generally "U" shaped adapter means includes a plurality of flanges secured to each leg of said "U" shaped adapter means with one flange directed inwardly of said "U" shaped adapter means and a second flange directed outwardly of said "U" shaped adapter means.

3. An air conditioner wall sleeve as set forth in claim 2 wherein said inwardly directed flange is of complementary configuration to an "L" shaped flange secured integrally to an interior surface of said wall means with said outwardly directed flange formed with openings for accepting attachment means for attaching said outwardly directed flange to said interior surface of a side wall.

4. An air conditioning wall sleeve as set forth in claim 3 wherein said "U" shaped adapter means are positioned proximate forward terminal edges of said first and second side walls.

5. An air conditioning wall sleeve as set forth in claim 4 wherein said generally "U" shaped adapter means are formed with a planar face wall integrally secured to parallel legs wherein said inwardly directed flange and said outwardly directed flange are secured to respective legs wherein said flanges are parallel to said face wall, and each face wall is parallel to a respective first wall or second wall when secured to an interior surface of said walls.

6. An air conditioning adapter sleeve as set forth in claim 5 wherein said louvers are generally parallel to each other and said top wall and bottom wall of said cabinet.

* * * * *